US008453853B1

(12) United States Patent
Adams

(10) Patent No.: US 8,453,853 B1
(45) Date of Patent: Jun. 4, 2013

(54) STORAGE RACK FOR MULTIPLE SKATEBOARDS AND ASSOCIATED METHOD

(76) Inventor: Othella Adams, Altadena, CA (US)

( * ) Notice: Subject to any disclaimer, the term of this patent is extended or adjusted under 35 U.S.C. 154(b) by 414 days.

(21) Appl. No.: 12/782,065

(22) Filed: May 18, 2010

(51) Int. Cl.
*A47F 7/00* (2006.01)
*E05B 73/00* (2006.01)
*B62H 5/02* (2006.01)

(52) U.S. Cl.
USPC ..... 211/85.7; 211/4; 211/180; 70/18; 70/58; 70/62; 70/233; 70/235

(58) Field of Classification Search
USPC ..... 211/4, 60.1, 64, 85.7, 87.01, 89.01, 211/180; 248/228.7, 231.81, 316.7; 70/2, 70/14, 18, 19, 58, 62, 233–235; 312/297
See application file for complete search history.

(56) References Cited

U.S. PATENT DOCUMENTS 2,946,452 A * 7/1960 Caloiero et al. ..... 211/4
3,091,011 A * 5/1963 Campbell ..... 280/814
3,326,385 A * 6/1967 Pinkerton et al. ..... 211/4
3,394,790 A * 7/1968 Braun ..... 194/256
3,504,405 A * 4/1970 Elliott-Smith ..... 70/58
3,636,739 A * 1/1972 Smedley ..... 70/58
3,643,811 A * 2/1972 Howerton ..... 211/64
3,754,420 A * 8/1973 Oellerich ..... 70/58
3,767,093 A * 10/1973 Pinkerton et al. ..... 224/569
3,838,585 A * 10/1974 Foote ..... 70/18
4,078,708 A * 3/1978 Mayer ..... 224/509
4,139,100 A * 2/1979 Reed ..... 211/4
4,248,399 A * 2/1981 Gipson ..... 248/552
4,596,334 A * 6/1986 Daulton ..... 211/64
4,673,088 A * 6/1987 Mancini ..... 211/70.5
5,120,012 A * 6/1992 Rosenau ..... 248/201
5,193,694 A * 3/1993 Wave ..... 211/70.5
5,301,818 A * 4/1994 Dix ..... 211/85.7
5,305,897 A * 4/1994 Smith ..... 211/85.7
5,316,155 A * 5/1994 Collins et al. ..... 211/70.5
5,472,101 A * 12/1995 Ahrens ..... 211/70.5
5,477,968 A * 12/1995 Largent et al. ..... 211/60.1
5,647,489 A * 7/1997 Bellis, Jr. ..... 211/70.6
5,676,257 A * 10/1997 Adkins ..... 211/4
5,706,680 A * 1/1998 Wroble ..... 70/18
5,901,588 A * 5/1999 Frost ..... 70/39
6,196,397 B1 * 3/2001 Maher ..... 211/85.7
6,293,412 B1 9/2001 Draper
6,481,581 B2 * 11/2002 Sipe ..... 211/4
6,619,485 B1 * 9/2003 Jenkins ..... 211/4
6,640,978 B2 * 11/2003 Reiser et al. ..... 211/4

(Continued)

*Primary Examiner* — Jonathan Liu
*Assistant Examiner* — Joshua Rodden

(57) ABSTRACT

A multi-skateboard storage rack may include a rigid frame and a plurality of vertical rods statically connected to the frame. A plurality of horizontal peg extensions may be attached to the rods. A plurality of locking jaws may be pivotally connected to corresponding ones of the peg extensions such that associated pairs of the locking jaws may be selectively articulated between a closed locked position and an open unlocked position respectively. Each pair of locking jaws includes a top and a bottom hook which may be independently articulated along mutually exclusive arcuate paths oriented about the corresponding peg extensions. A plurality of locks may be removably fastened to the associated pairs of locking jaws for prohibiting the pairs of locking jaws from being articulated. The multi-skateboard storage rack may further include a plurality of non-linear guide tracks attached to the frame. The multi-skateboard storage rack may further include an optional flexible fenced closure formed from a mesh screen.

12 Claims, 8 Drawing Sheets

U.S. PATENT DOCUMENTS

| | | | | |
|---|---|---|---|---|
| 6,695,154 | B2 | 2/2004 | Jacobs | |
| 6,978,902 | B2 | 12/2005 | Loch | |
| D554,391 | S * | 11/2007 | Kostigian | D6/462 |
| 7,950,535 | B1 * | 5/2011 | Schmid | 211/85.7 |
| 8,123,051 | B2 * | 2/2012 | Johnson et al. | 211/87.01 |
| 8,251,342 | B1 * | 8/2012 | Weiner | 248/690 |
| 2002/0060194 | A1 * | 5/2002 | Reiser et al. | 211/4 |
| 2002/0144962 | A1 * | 10/2002 | Dettorre et al. | 211/85.7 |
| 2003/0010735 | A1 * | 1/2003 | Wuerth | 211/85.7 |
| 2007/0235400 | A1 * | 10/2007 | Wald | 211/85.7 |
| 2009/0159540 | A1 * | 6/2009 | Meeks | 211/64 |

* cited by examiner

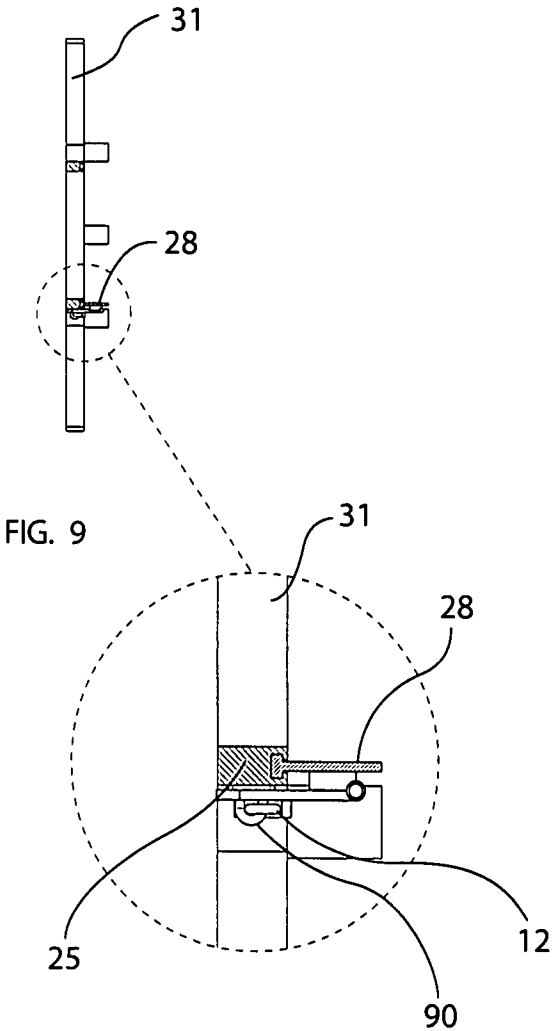
FIG. 9
FIG. 10
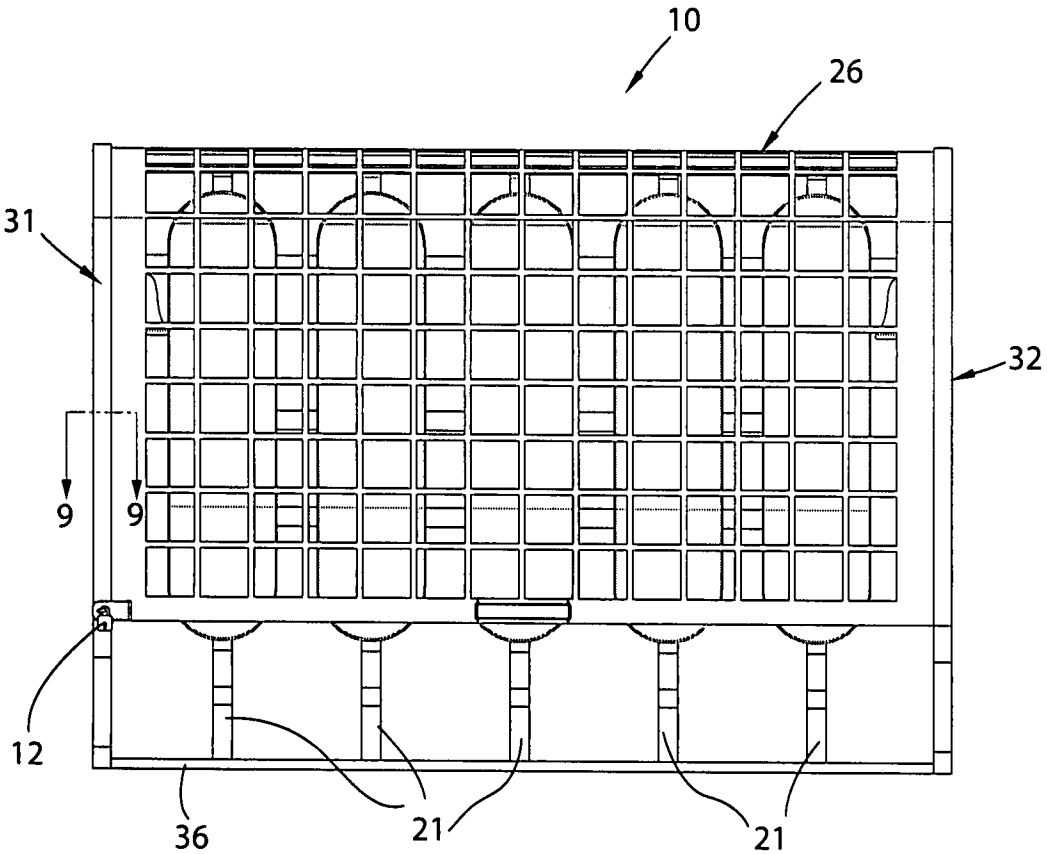
FIG. 8

STORAGE RACK FOR MULTIPLE SKATEBOARDS AND ASSOCIATED METHOD

CROSS REFERENCE TO RELATED APPLICATIONS

Statement Regarding Federally Sponsored Research or Development

Not Applicable.

REFERENCE TO A MICROFICHE APPENDIX

Not Applicable.

BACKGROUND OF THE INVENTION

1. Technical FIELD

This invention relates to storage racks and, more particularly, to a rack for multiple skateboards for providing users with an easy and convenient means of safekeeping their skateboards.

2. Prior ART

Skateboards have become a prevalent mode of transportation for today's youth. It is rare to find a child that has not ridden a skateboard, and most use skateboards daily. A conventional skateboard, in its typical form, includes a deck usually made from wood, and a pair of wheel assemblies located at the front and back ends of the deck. Each wheel assembly typically includes a set of trucks, which are attached to the deck, and a pair of wheels that extend from each end of the trucks. The problem with the popularity of the skateboard is that they have become coveted by thieves. Since there has been no reliable means for the users to secure their skateboards in public locations, many individuals find themselves carrying their skateboards with them wherever they go. This presents a particular problem for the schools, malls, parks and many other public establishments since these locations do not typically have an appropriate place for a skateboard to be stored. Obviously, it would be advantageous to provide a means for storing skateboards at these locations when not in use.

Accordingly, a need remains for an storage rack in order to overcome the above-noted shortcomings. The present invention satisfies such a need by providing a rack for multiple skateboards that is convenient and easy to use, is durable yet lightweight in design, is versatile in its applications, and provides an easy and convenient means of safekeeping users' skateboards when not in use.

BRIEF SUMMARY OF THE INVENTION

In view of the foregoing background, it is therefore an object of the present invention to provide an storage rack for safekeeping multiple skateboards and preventing unauthorized access to the skateboards. These and other objects, features, and advantages of the invention are provided by a storage rack for multiple skateboards.

The multi-skateboard storage rack may include a rigid frame adapted to be anchored to a support surface. A plurality of vertical rods may be statically connected to the frame. A plurality of horizontal peg extensions may be attached to the rods in such a manner that the peg extensions are pivotally coupled to corresponding ones of the rods respectively. A plurality of locking jaws may be pivotally connected to corresponding ones of the peg extensions such that associated pairs of the locking jaws may be selectively articulated between a closed locked position and an open unlocked position respectively. The pair of locking jaws may further be independently articulated along mutually exclusive arcuate paths oriented about the corresponding peg extensions.

A plurality of locks may be removably fastened to the associated pairs of locking jaws for prohibiting the pair of locking jaws from being articulated. The multi-skateboard storage rack may further include a plurality of non-linear guide tracks attached to the frame. Such an arrangement provides the unexpected and unpredictable advantage of securing a plurality of skateboards to the storage rack in a safe manner but is easily removed when needed by a user.

In an alternate embodiment, the multi-skateboard storage rack may include an optional flexible fenced closure formed from a mesh screen. The optional flexible fenced closure may include a guide pin statically attached to it such that the guide pin may be slidably mated to one of the guide tracks. In this way, the optional fenced closure may be selectively displaced along an outer perimeter edge of the frame and thereby covers the anterior and posterior faces of the frame. Such an arrangement provides the unexpected and unpredictable advantage of enclosing the skateboard within the optional fenced closure to prevent possible damage to the skateboards by an external element. The mesh screen also provides a protected but visible enclosure for users to easily identify their skateboards when retrieving them for use.

The frame may include first and second end support members each preferably having an arcuate top portion and a flat base portion respectively. The frame may further include a top linear member traversing the vertical rods and conjoined to the top portion of the arcuate top portions respectively. A plurality of bottom linear members may be registered orthogonal to the vertical rods and conjoined to the base portion of the first and second support members respectively.

The frame may further include a plurality of protection bars traversing the vertical rods and intermediately positioned between the top and bottom linear members respectively. In this way, the protection bars may be positioned posterior of the peg extensions for limiting access to an interior of the frame. Such an arrangement provides the unexpected and unpredictable advantage of protecting the skateboards and yet has a pleasant looking structure for the storage rack. The broader base portion may further ensure a stable platform in which the storage rack may be easily placed on a flat surface without the danger of being toppled easily by a lateral force on its sides.

Each of the locking jaws may be provided with an eyelet, such that corresponding ones of the eyelets may be selectively aligned when the locking jaw pairs are adapted to engage the skateboards. Such an arrangement provides the unexpected and unpredictable advantage of allowing users to easily use their own padlocks to secure their skateboards with the storage rack without fear of their skateboards being stolen.

The optional fenced closure may include a plurality of bell weights attached to the fence enclosure. A lock ring may be attached to one of the guide tracks. A lock bracket may be pivotally connected to the fenced closure. The lock bracket preferably has a slot removably mated with the lock bracket such that when the fence enclosure is lowered to the closed locked position, one of the locks may be detachably engaged with the lock ring for prohibiting the fence closure from being prematurely lifted to the open unlocked position. Such an arrangement provides the unexpected and unpredictable advantage of allowing the optional fenced closure to be slidably moved to an open or close position by users when storing their skateboards and closing the optional fenced closure after securing their skateboards to the storage rack respectively.

Each of the pairs of locking jaws may include a top J-hook pivotally coupled to the associated peg extensions and a bottom J-hook pivotally coupled to the associated peg extensions respectively. Further, the top and bottom J-hooks may be vertically offset such that the mutually exclusive paths are non-overlapping. Such an arrangement provides the unexpected and unpredictable advantage of easily clamping the J-hooks over the axles of the skateboard wheels on both sides of the vertical rods to prevent the skateboard from being easily removed by unauthorized persons.

The invention may further include a method of utilizing a multi-skateboard storage rack for safekeeping multiple skateboards and preventing unauthorized access to the skateboards. Such a method may include the chronological steps of: providing and anchoring a rigid frame to a support surface; providing and statically connecting a plurality of vertical rods to the frame; providing and attaching a plurality of horizontal peg extensions to the rods; pivotally coupling the peg extensions to corresponding ones of the rods respectively; providing and pivotally connecting a plurality of locking jaws to corresponding ones of the peg extensions respectively; selectively articulating associated pairs of the locking jaws between a closed locked position and an open unlocked position respectively; independently articulating the locking jaw pairs along mutually exclusive arcuate paths oriented about the corresponding peg extensions; and after the pairs of locking jaws engage a skateboard, prohibiting the pairs of locking jaws from being articulated by providing and removably fastening a plurality of locks to the associated pairs of locking jaws.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 8 is a front elevational view of the storage rack with the optional fenced closure in a closed and locked position;

FIG. 9 is a cross-sectional view taken along line 9-9 in FIG. 8;

FIG. 10 is an enlarged view showing the interrelationship between the guide track, pin and lock shown in FIG. 9;

Figure 1:
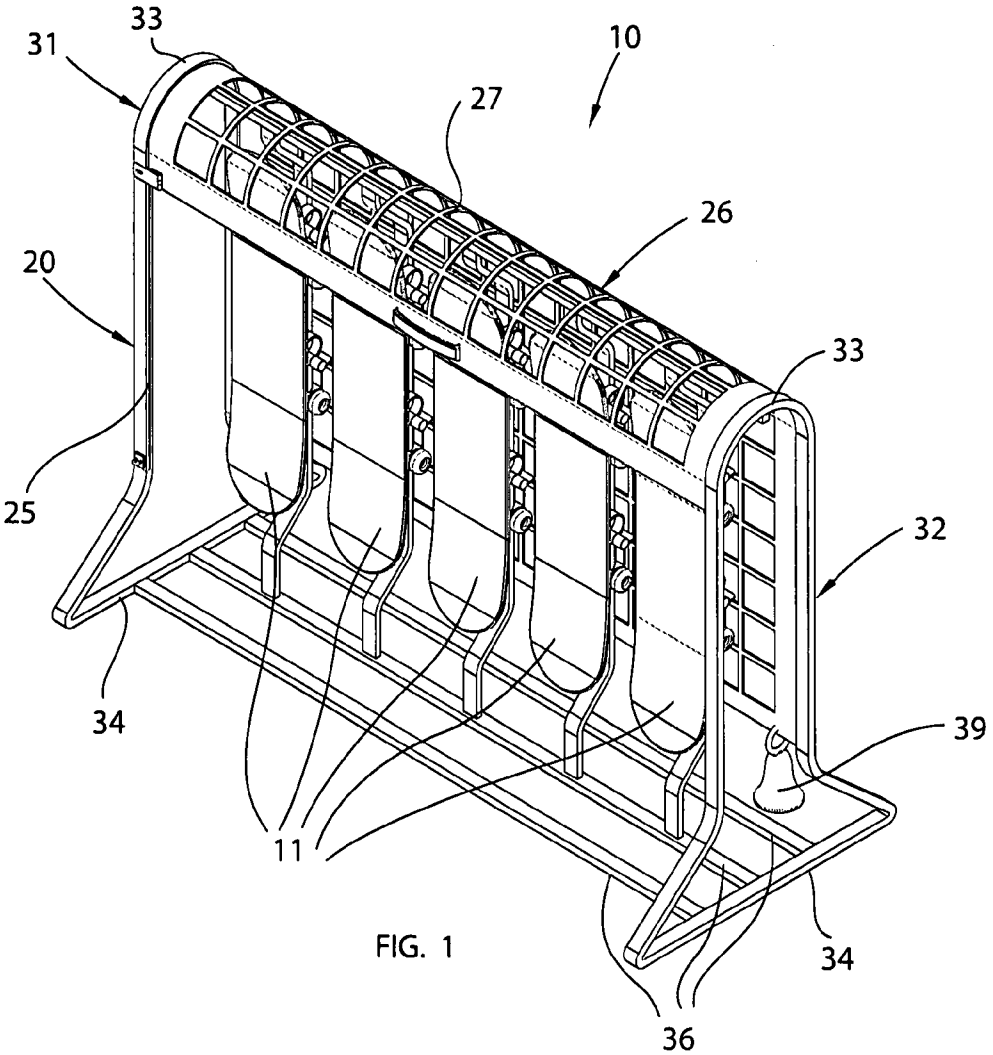
FIG. 1 is a perspective view showing a storage rack for multiple skateboards with an optional fenced closure, in accordance with the present invention.
Figure 3:
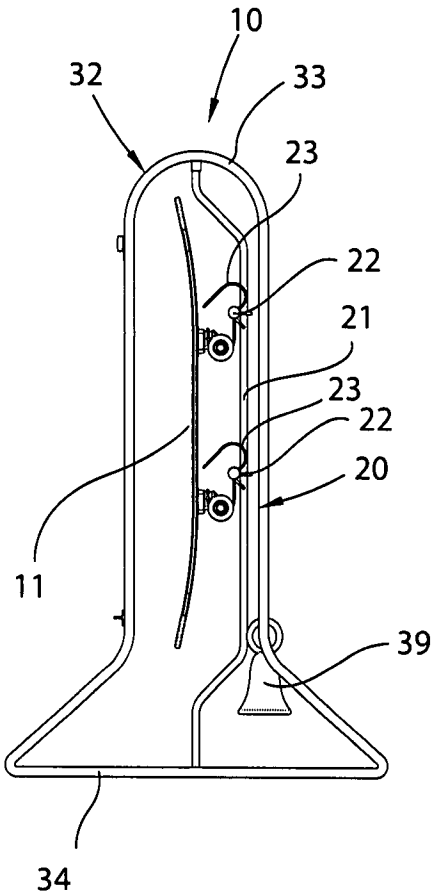
FIG. 3 is a right side elevational view of the storage rack shown in FIG. 1.
Figure 2:
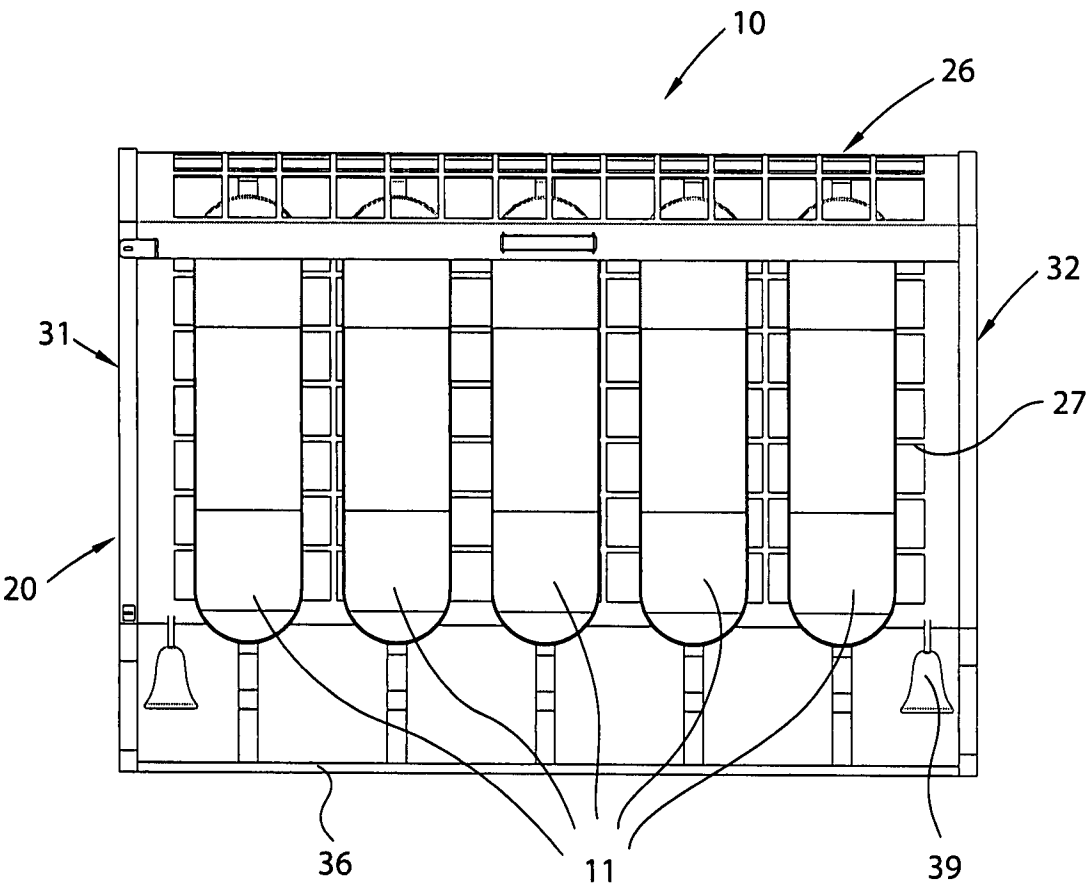
FIG. 2 is a front elevational view of the storage rack shown in FIG. 1.
Figure 4:
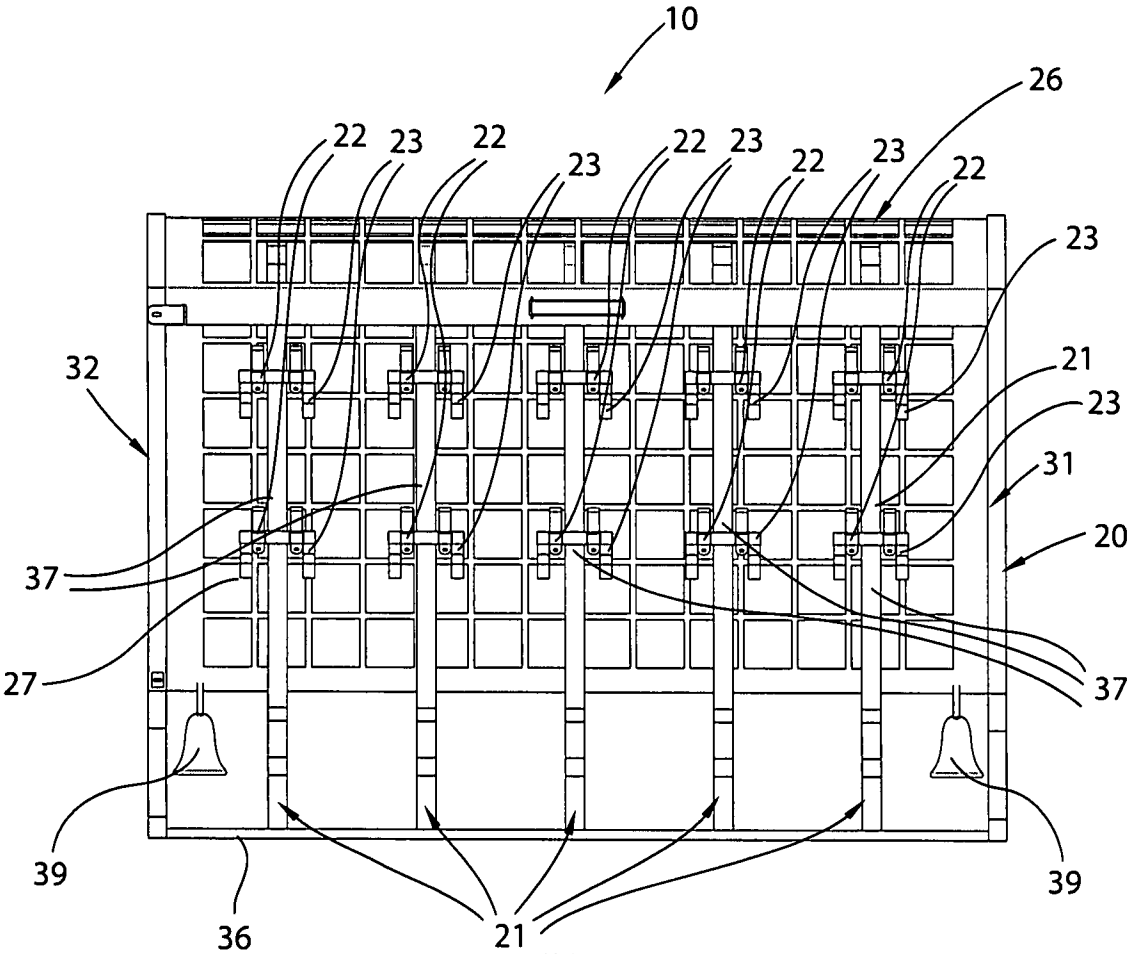
FIG. 4 is a rear elevational view of the storage rack shown in FIG. 1.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of storage rack and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The storage rack of this invention is referred to generally in FIGS. 1-12 by reference numeral 10 and is intended to provide a storage rack for multiple skateboards. It should be understood that the multi-skateboard storage rack 10 may be used to provide users with an easy and convenient means of safekeeping their skateboards and many different types of elongated sports equipment having like structures.

Referring initially to FIGS. 1-12 as a whole, the multi-skateboard storage rack 10 preferably includes a rigid frame 20 adapted to be anchored to a support surface. A plurality of vertical rods 21 may be statically connected to the frame 20. A plurality of horizontal peg extensions 22 may be attached to the rods 21 in such a manner that the peg extensions 22 are pivotally coupled to corresponding ones of the rods 21 respectively.

A plurality of locking jaws 23 may be pivotally connected to corresponding ones of the peg extensions 22 such that associated pairs of the locking jaws 23 may be selectively articulated between a closed locked position (FIG. 11) and an open unlocked position (FIG. 12), respectively. The pair of locking jaws 23 may further be independently articulated along mutually exclusive arcuate paths 90, 91 oriented about the corresponding peg extensions 22. As perhaps best shown in FIG. 11, a plurality of locks 24 may be removably fastened to the associated pairs of locking jaws 23 for prohibiting the pair of locking jaws 23 from being articulated. A plurality of peg extensions 22 and locking jaws 23 may further be connected at an upper and lower portion of the vertical rods 21 such that a skateboard 11 may be adequately secured to the vertical rods 21 by both its trucks. Such a structural arrangement provides the unexpected and unpredictable advantage of independently and simultaneously securing a plurality of skateboards 11 to the storage rack 10 such that each skateboard 11 can be separately detached from frame 20.

Figure 5:
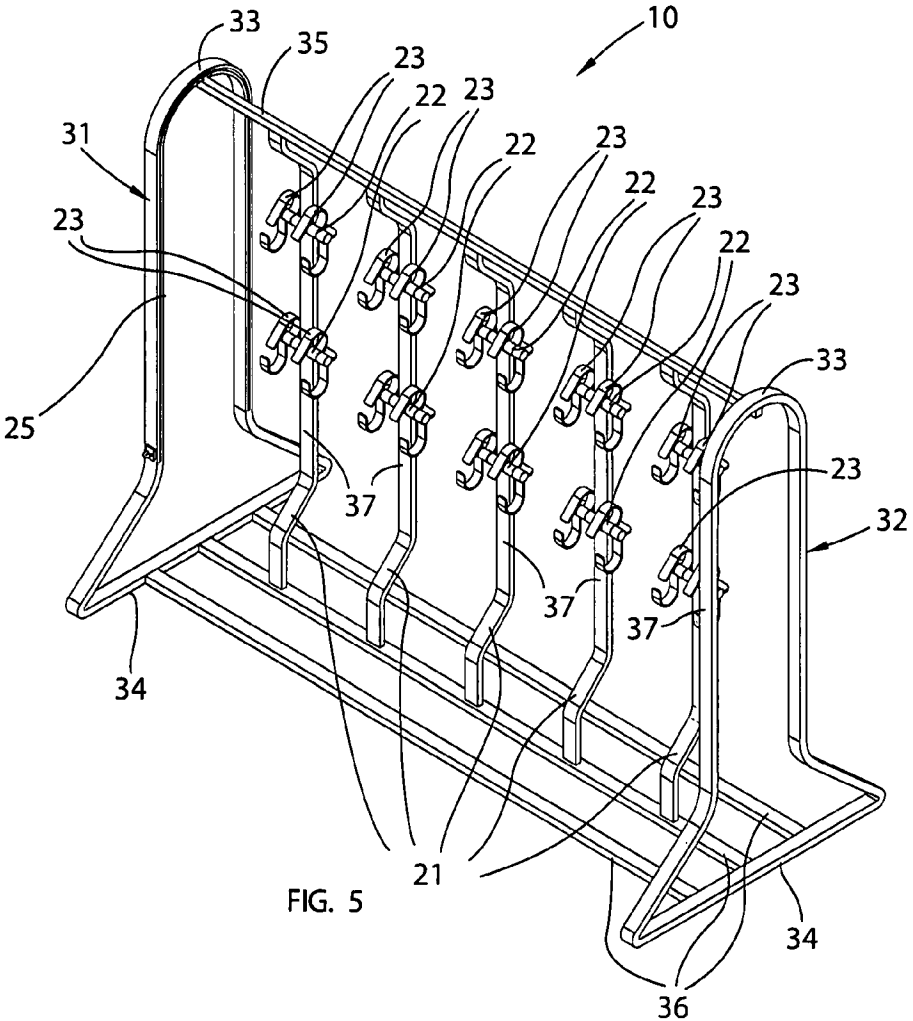
FIG. 5 is a perspective view of the storage rack shown without the optional fenced closure.
Figure 7:
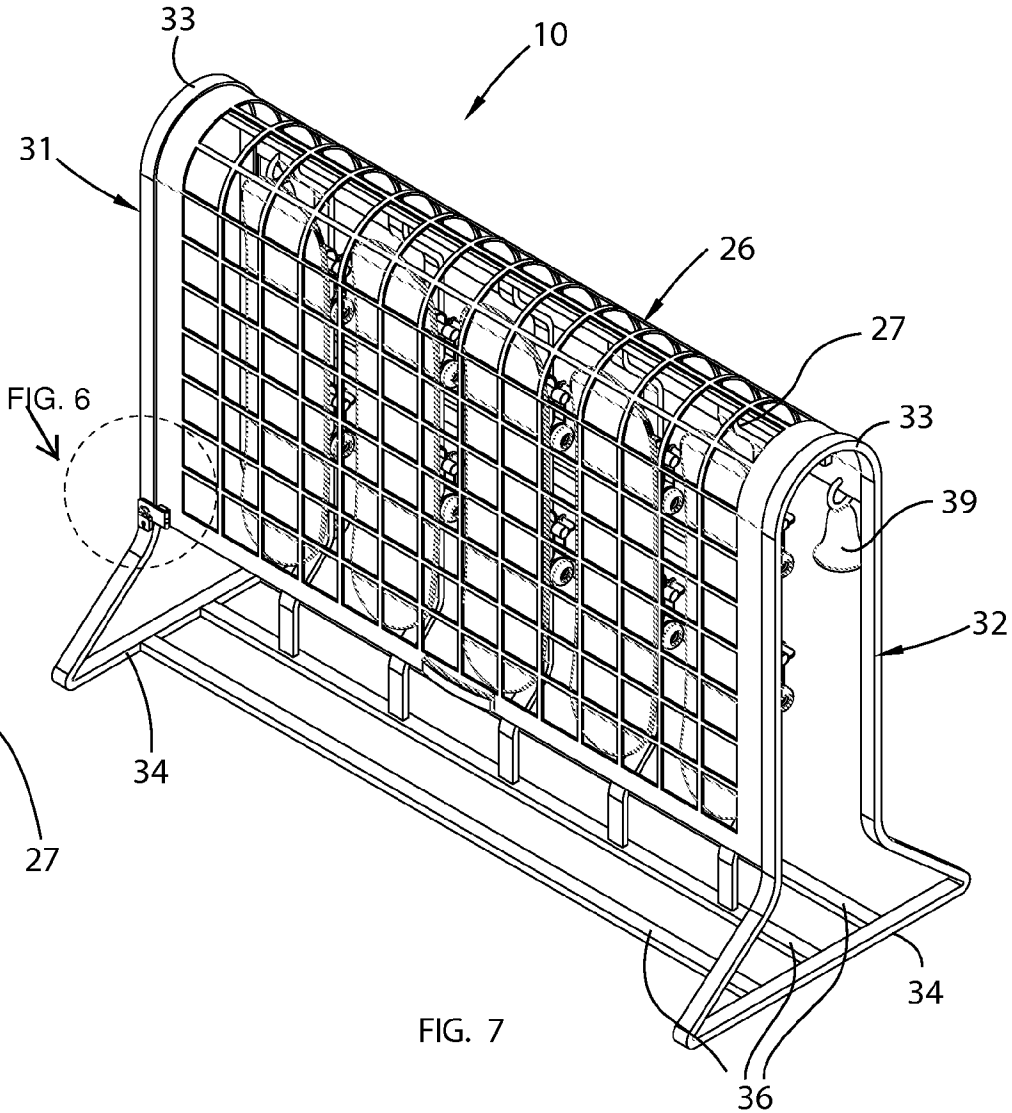
FIG. 7 is a perspective view of the storage rack with the optional fenced closure in a closed position.

Referring to FIGS. 1-8, the frame 20 may include first and second end support members 31, 32 each preferably having an arcuate top portion 33 and a flat base portion 34 respectively. Referring to FIG. 5, the frame 20 may further include a top linear member 35 traversing the vertical rods 21 and conjoined to the top portion of the arcuate top portions 33, respectively. A plurality of bottom linear members 36 may be registered orthogonal to the vertical rods 21 and conjoined to the base portion 34 of the first and second support members 31, 32 respectively. Such a structural arrangement provides the unexpected and unpredictable advantage of maintaining frame 20 at a stable position such that end support members 31, 32 remain fixedly spaced apart.

The frame 20 may further include a plurality of protection bars 37 traversing the vertical rods 21 and intermediately positioned between the top and bottom linear members 35, 36 respectively. In this way, the protection bars 37 may be positioned posterior of the peg extensions 22 for limiting access to an interior of the frame 20. Such an arrangement provides the unexpected and unpredictable advantage of protecting the skateboards 11 without obstructing access to the skateboards 11 from an anterior side of the storage rack 10. The broader base portion 34 may further ensure a stable platform in which the storage rack 10 may be easily placed on a flat surface without the danger of being toppled easily by a lateral force on its sides.

As perhaps best shown in FIG. 5, the multi-skateboard storage rack 10 may include a plurality of non-linear guide tracks 25 attached to the frame 20. It is understood that each end support member 31, 32 includes a respective track 25; thereby providing two tracks 25. Such a structural arrangement provides the unexpected and unpredictable advantage of securing a plurality of skateboards 11 to the storage rack 10 in a safe manner but is easily removed when needed by a user.

Referring to FIGS. 1, 2, 4, 7 and 8, the multi-skateboard storage rack 10 includes an optional flexible fenced closure 26 formed from a mesh screen 27. As best shown in FIGS. 9 and 10, the optional flexible fenced closure 26 may include a guide pin 28 statically attached to it such that the guide pin 28 may be slidably mated to one of the guide tracks 25. In this way, the optional fenced closure 26 may be selectively displaced along an outer perimeter edge of the frame 20 and thereby covers the anterior and posterior faces of the frame 20. Such a structural arrangement provides the unexpected and unpredictable advantage of enclosing the skateboard within the optional fenced closure 26 to prevent possible damage to the skateboards 11 by an external element. The mesh screen 27 also provides a protected but visible enclosure 26 for users to easily identify their skateboards 11 when retrieving them for use.

Referring now to FIGS. 9-12, each of the locking jaws 23 may be provided with an eyelet 38, such that corresponding ones of the eyelets 38 may be selectively aligned when locking jaws 23 are adapted to engage the skateboards 11. Such an arrangement provides the unexpected and unpredictable advantage of allowing users to easily use their own padlocks 24 to secure their skateboards 11 with the storage rack 10 without fear of their skateboards 11 being stolen.

Figure 6:
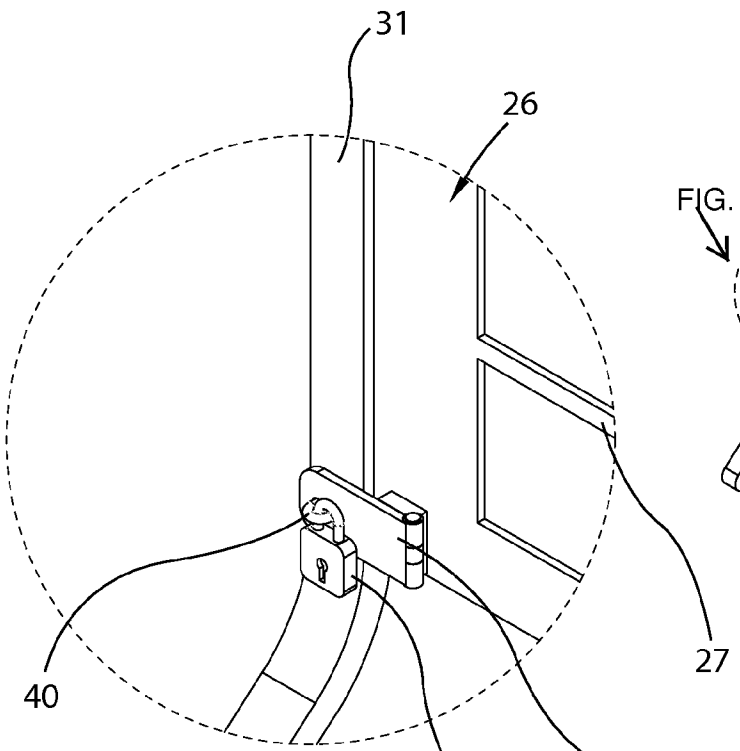
FIG. 6 is an enlarged view of the lock ring and bracket for the optional fenced closure shown in FIG. 6.

Referring now to FIGS. 1-4 and 7, the optional fenced closure 26 may include a plurality of bell weights 39 attached to the fence enclosure 26. As shown in FIG. 6, a lock ring 40 may be attached to one of the guide tracks 25. A lock bracket 41 may be pivotally connected to the optional fenced closure 26. The lock bracket 41 preferably has a slot removably mated with the lock ring 40 such that when the optional fence enclosure 26 is lowered to the closed locked position, one of the locks 24 may be detachably engaged with the lock ring 40 for prohibiting the optional fence closure 26 from being prematurely lifted to the open unlocked position. Such an arrangement provides the unexpected and unpredictable advantage of allowing the fenced closure 26 to be slidably moved to an open position by only authorized users when storing/retrieving their skateboards 11 and thereafter closing the fenced closure 26 after securing/retrieving their skateboards 11 from the storage rack 10, respectively.

Figure 11:
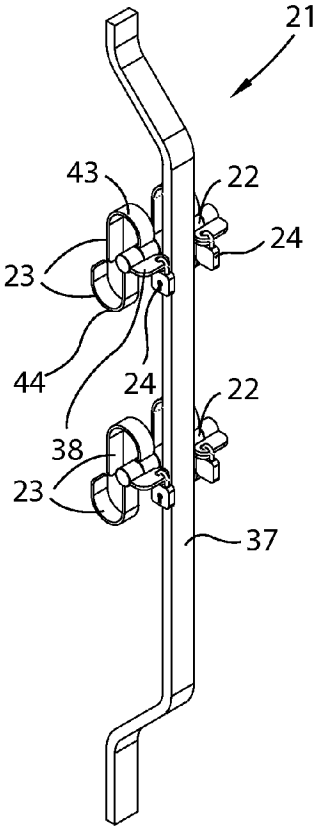
FIG. 11 is a perspective view of the locking jaws showing the top and bottom J-hooks in a locked position with the eyelets at an aligned position.
Figure 12:
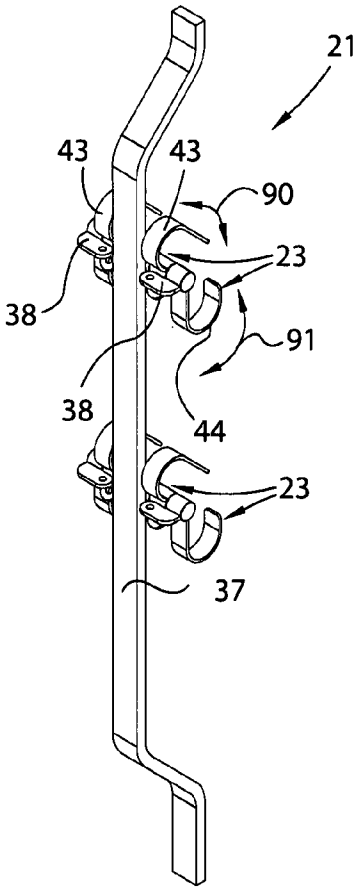
FIG. 12 is a perspective view of the locking jaws showing the top and bottom J-hooks in an unlocked position with the eyelets at an unaligned position.

Referring to FIGS. 11 and 12, each locking jaw 23 may include a top J-hook 43 pivotally coupled to an associated peg extension 22 and a bottom J-hook 44 pivotally coupled to an associated peg extension 22, respectively. The top and bottom J-hooks 43, 44 may be vertically offset such that the mutually exclusive paths 90, 91 are non-overlapping. Such an arrangement provides the unexpected and unpredictable advantage of easily clamping the J-hooks over the axles of the skateboard 11 wheels on both sides of the vertical rods 21 to prevent the skateboard 11 from being easily removed by unauthorized users.

The invention may further include a method of utilizing a multi-skateboard storage rack 10 for safekeeping multiple skateboards 11 and preventing unauthorized access to the skateboards 11. Such a method may include the chronological steps of: providing and anchoring a rigid frame 20 to a support surface; providing and statically connecting a plurality of vertical rods 21 to the frame 20; providing and attaching a plurality of horizontal peg extensions 22 to the rods 21; pivotally coupling the peg extensions 22 to corresponding ones of the rods 21 respectively; and providing and pivotally connecting a plurality of locking jaws 23 to corresponding ones of the peg extensions 22 respectively.

The method may further include the chronological steps of: selectively articulating associated pairs of the locking jaws 23 between a closed locked position and an open unlocked position respectively; independently articulating the pairs of locking jaws 23 along mutually exclusive arcuate paths 90, 91 oriented about the corresponding peg extensions 22; and after the pair of locking jaws 23 engage a skateboard 11, prohibiting the pairs of locking jaws 23 from being articulated by providing and removably fastening a plurality of locks 24 to the associated pairs of locking jaws 23.

The combination of such claimed elements provides an unpredictable and unexpected benefit of independently and simultaneously safekeeping users' skateboards in public areas. This structural configuration advantageously solves the problem of users, especially young children having to lug the skateboards wherever they go. In this way, users will to enjoy hanging out at skateboard restricted areas such as retail businesses, malls and movie theaters, confident that their skateboards are safely secured outside. Businesses in turn will benefit as skateboard enthusiasts are more apt to frequent their establishments knowing they have a convenient means of safeguarding their equipment. Additionally, skaters can use their skateboards to get to school without having to worry about getting in trouble for bringing their skateboards inside the school buildings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A multi-skateboard storage rack for safekeeping multiple skateboards and preventing unauthorized access to the skateboards, said multi-skateboard storage rack comprising:

a frame adapted to be anchored to a support surface;

a plurality of vertical rods connected to said frame;

a plurality of horizontal peg extensions attached to said rods, said peg extensions being coupled to corresponding ones of said rods respectively;

a plurality of locking jaws connected to corresponding ones of said peg extensions respectively, associated pairs of said locking jaws being selectively articulated between a closed locked position and an open unlocked position respectively, said associated pairs of said locking jaws being independently articulated along mutually exclusive arcuate paths oriented about said corresponding peg extensions; and a plurality of locks fastened to said associated pairs of locking jaws for prohibiting said associated pairs of said locking jaws from being articulated;

a plurality of non-linear guide tracks attached to said frame; and a flexible fenced closure formed from a mesh screen and having a guide pin statically attached thereto;

wherein said guide pin is slidably mated to one of said guide tracks such that said fenced closure is selectively displaced along an outer perimeter edge of said frame and thereby covers anterior and posterior faces of said frame.

2. The multi-skateboard storage rack of claim 1, wherein said frame comprises:

first and second end support members each having an arcuate top portion and a flat base portion respectively;

a top linear member traversing said vertical rods and conjoined to a top portion of said arcuate top portions respectively; and a plurality of bottom linear members registered orthogonal to said vertical rods and conjoined to said base portion of said first and second support members respectively.

3. The multi-skateboard storage rack of claim 2, further comprising: a plurality of protection bars traversing said vertical rods and intermediately positioned between said top and bottom linear members;

wherein said protection bars are positioned posterior of said peg extensions for limiting access to an interior of said frame.

4. The multi-skateboard storage rack of claim 3, wherein each of said locking jaws is provided with an eyelet, corresponding ones of said eyelets being selectively aligned when said associated pairs of said locking jaws are adapted to engage the skateboards.

5. The multi-skateboard storage rack of claim 4, wherein said fenced closure comprises:

a plurality of bell weights attached to said fence enclosure;

a lock ring attached to one of said guide tracks; and a lock bracket pivotally connected to said fence enclosure, said lock bracket having a slot removably mated with said lock ring when said fence enclosure is lowered to said closed locked position;

wherein one of said locks is detachably engaged with said lock ring for prohibiting said fence enclosure from being prematurely lifted to said open unlocked position.

6. The multi-skateboard storage rack of claim 5, wherein each of said associated pairs of said locking jaws comprises:

a top J-hook pivotally coupled to one of said peg extensions; and a bottom J-hook pivotally coupled to said one of said peg extensions;

wherein said top and bottom J-hooks are vertically offset such that said mutually exclusive paths are non-overlapping.

7. A multi-skateboard storage rack for safekeeping multiple skateboards and preventing unauthorized access to the skateboards, said multi-skateboard storage rack comprising:

a rigid frame adapted to be anchored to a support surface;

a plurality of vertical rods statically connected to said frame;

a plurality of horizontal peg extensions attached to said rods, said peg extensions being pivotally coupled to corresponding ones of said rods respectively;

a plurality of locking jaws pivotally connected to corresponding ones of said peg extensions respectively, associated pairs of said locking jaws being selectively articulated between a closed locked position and an open unlocked position respectively, said associated pairs of said locking jaws being independently articulated along mutually exclusive arcuate paths oriented about said corresponding peg extensions; and a plurality of locks removably fastened to said associated pairs of locking jaws for prohibiting said associated pairs of said locking jaws from being articulated;

a plurality of non-linear guide tracks attached to said frame; and a flexible fenced closure formed from a mesh screen and having a guide pin statically attached thereto;

wherein said guide pin is slidably mated to one of said guide tracks such that said fenced closure is selectively displaced along an outer perimeter edge of said frame and thereby covers anterior and posterior faces of said frame.

8. The multi-skateboard storage rack of claim 7, wherein said frame comprises:

first and second end support members each having an arcuate top portion and a flat base portion respectively;

a top linear member traversing said vertical rods and conjoined to a top portion of said arcuate top portions respectively; and a plurality of bottom linear members registered orthogonal to said vertical rods and conjoined to said base portion of said first and second support members respectively.

9. The multi-skateboard storage rack of claim 8, further comprising: a plurality of protection bars traversing said vertical rods and intermediately positioned between said top and bottom linear members;

wherein said protection bars are positioned posterior of said peg extensions for limiting access to an interior of said frame.

10. The multi-skateboard storage rack of claim 9, wherein each of said locking jaws is provided with an eyelet, corresponding ones of said eyelets being selectively aligned when said associated pairs of said locking jaws are adapted to engage the skateboards.

11. The multi-skateboard storage rack of claim 10, wherein said fenced closure comprises:

a plurality of bell weights attached to said fence enclosure;

a lock ring attached to one of said guide tracks; and a lock bracket pivotally connected to said fence enclosure, said lock bracket having a slot removably mated with said lock ring when said fence enclosure is lowered to said closed locked position;

wherein one of said locks is detachably engaged with said lock ring for prohibiting said fence enclosure from being prematurely lifted to said open unlocked position.

12. The multi-skateboard storage rack of claim 11, wherein each of said associated pairs of said locking jaws comprises:

a top J-hook pivotally coupled to one of said peg extensions; and a bottom J-hook pivotally coupled to said one of said peg extensions;

wherein said top and bottom J-hooks are vertically offset such that said mutually exclusive paths are non-overlapping.

* * * * *